US012637252B2

(12) United States Patent
Bandla et al.

(10) Patent No.: US 12,637,252 B2
(45) Date of Patent: May 26, 2026

(54) HANDLE FOR A CONTAINER

(71) Applicant: NIAGARA BOTTLING, LLC, Diamond Bar, CA (US)

(72) Inventors: Sudheer Bandla, Rancho Cucamonga, CA (US); Melissa Cronin, Alhambra, CA (US); Mark Doherty, Aliso Viejo, CA (US)

(73) Assignee: Niagara Bottling, LLC, Diamond Bar, CA (US)

( * ) Notice: Subject to any disclaimer, the term of this patent is extended or adjusted under 35 U.S.C. 154(b) by 0 days.

(21) Appl. No.: 18/725,027

(22) PCT Filed: Jan. 19, 2023

(86) PCT No.: PCT/US2023/060920
§ 371 (c)(1),
(2) Date: Jun. 27, 2024

(87) PCT Pub. No.: WO2023/141516
PCT Pub. Date: Jul. 27, 2023

(65) Prior Publication Data

US 2025/0074655 A1 Mar. 6, 2025

Related U.S. Application Data

(60) Provisional application No. 63/300,972, filed on Jan. 19, 2022.

(51) Int. Cl.
*B65D 23/10* (2006.01)

(52) U.S. Cl.
CPC ..... *B65D 23/108* (2013.01)

(58) Field of Classification Search
CPC ..... B65D 23/108; B65D 5/4208; B65D 5/46; B65D 23/10; B65D 23/102;
(Continued)

(56) References Cited

U.S. PATENT DOCUMENTS 3,463,536 A * 8/1969 Beyer ..... A47J 45/077 215/396
4,090,729 A 5/1978 Erickson
(Continued)

FOREIGN PATENT DOCUMENTS

CN 200992325 Y 12/2007
CN 103274110 A 9/2013
(Continued)

OTHER PUBLICATIONS

International Search Report and Written Opinion for Application No. PCT/US2023/060920 dated Jun. 26, 2023 (15 pages).
(Continued)

*Primary Examiner* — Kareen K Thomas
(74) *Attorney, Agent, or Firm* — Michael Best & Friedrich LLP

(57) ABSTRACT

A bottle handle includes a neck engagement collar including a neck ring defining a central aperture. The bottle handle also includes a handle portion coupled to the neck engagement collar. The bottle handle further includes a plurality of tabs extending radially inward from the neck ring. Two adjacent tabs of the plurality of tabs define a slot therebetween, and wherein a reinforcement rib protrudes from the neck ring and is located adjacent the slot.

8 Claims, 8 Drawing Sheets

(58) Field of Classification Search
CPC ..... B65D 71/0011; B65D 2525/289; B65D 2571/00432; A45F 5/10; A45F 5/1583; A47G 19/065; A47J 45/066
See application file for complete search history.

(56) References Cited

U.S. PATENT DOCUMENTS

| | | | | |
|---|---|---|---|---|
| 5,301,857 | A | 4/1994 | Green | |
| 5,480,204 | A | 1/1996 | Erickson | |
| 5,735,562 | A | 4/1998 | Borg | |
| 6,394,517 | B1 * | 5/2002 | Borg | B65D 23/108 215/397 |
| 6,715,810 | B2 | 4/2004 | Borg | |
| 6,789,828 | B1 | 9/2004 | Borg | |
| D502,395 | S | 3/2005 | Blanchester | |
| 6,880,714 | B2 | 4/2005 | Blanchester | |
| D510,268 | S | 10/2005 | Blanchester | |
| 7,097,061 | B2 | 8/2006 | Simpson, Jr. et al. | |
| 7,108,128 | B2 | 9/2006 | Borg | |
| 7,210,602 | B2 | 5/2007 | Blancheste | |
| 7,481,325 | B2 | 1/2009 | Simpson, Jr. et al. | |
| D667,299 | S | 9/2012 | Dom | |
| 9,499,303 | B2 | 11/2016 | Glaser et al. | |
| 9,708,100 | B2 | 7/2017 | Meinzinger et al. | |
| 10,266,326 | B2 | 4/2019 | Borg et al. | |
| 10,273,051 | B2 | 4/2019 | Ring et al. | |
| 10,829,283 | B2 | 11/2020 | Borg et al. | |
| 2002/0084240 | A1 | 7/2002 | Yu-hsien | |
| 2004/0256250 | A1 | 12/2004 | Borg | |
| 2005/0167289 | A1 | 8/2005 | Borg | |
| 2005/0205436 | A1 * | 9/2005 | Erickson | B65D 23/108 206/139 |
| 2007/0068828 | A1 | 3/2007 | Scarrone et al. | |
| 2007/0221682 | A1 | 9/2007 | Blanchester | |
| 2013/0008915 | A1 * | 1/2013 | Dorn | B65D 23/104 220/755 |
| 2015/0041427 | A1 * | 2/2015 | Taw | A45F 5/102 215/396 |
| 2018/0016062 | A1 | 1/2018 | Ring et al. | |
| 2020/0270023 | A1 * | 8/2020 | Sunohara | B65D 21/0231 |
| 2022/0227533 | A1 | 7/2022 | Doherty | |

FOREIGN PATENT DOCUMENTS

| | | | |
|---|---|---|---|
| EP | 1803654 | B1 | 2/2008 |
| WO | 2003062071 | A1 | 7/2003 |
| WO | 2006013424 | A1 | 2/2006 |
| WO | 2006048469 | A1 | 5/2006 |
| WO | 2008001971 | A1 | 1/2008 |
| WO | 2018068105 | A1 | 4/2018 |

OTHER PUBLICATIONS

International Search Report and Written Opinion for Application No. PCT/US2022/012519 dated Apr. 13, 2022 (14 pages).
International Preliminary Report on Patentability for Application No. PCT/US2023/060920 dated Jul. 23, 2024 (7 pages).

* cited by examiner

HANDLE FOR A CONTAINER

CROSS-REFERENCE TO RELATED APPLICATIONS

This application claims priority to U.S. Provisional Patent Application No. 63/300,972 filed on Jan. 19, 2022, the content of which is incorporated herein by reference.

FIELD

The present disclosure relates to containers. More specifically, the present disclosure relates to a handle that couples to a container to facilitate carrying the container.

BACKGROUND

Containers, such as plastic containers, can include a neck that attaches to a separate handle for carrying the container.

SUMMARY

The present disclosure provides, in one aspect, a bottle handle including a neck engagement collar having a neck ring defining a central aperture. The bottle handle also includes a handle portion coupled to the neck engagement collar. The bottle handle further includes a plurality of tabs extending radially inward from the neck ring. Two adjacent tabs of the plurality of tabs define a slot therebetween, and a reinforcement rib protrudes from the neck ring and is located adjacent the slot.

The present disclosure provides, in another aspect, a bottle handle including a neck engagement collar having a neck ring defining a central aperture. The bottle handle also includes a handle portion coupled to the neck engagement collar, the handle portion including a first arm and a second arm each extending from opposite ends of the neck ring such that a first arcuate corner is formed with the neck ring and the first arm and a second arcuate corner is formed with the neck ring and the second arm. The bottle handle further includes a reinforcement rib extending at least partially around the first arcuate corner on a surface adjoining the neck ring with the first arm.

The present disclosure provides, in another aspect, a bottle handle including a neck engagement portion including a neck ring defining a central aperture and a plurality of tabs extending radially inward from the neck ring. The bottle handle also includes a handle portion coupled to the neck engagement portion. The bottle handle further includes a first planar surface defined by the neck engagement portion and the handle portion, and a second planar surface defined by the neck engagement portion and the handle portion and located opposite the first planar surface. The bottle handle also includes a first reinforcement rib protruding from and extending along the first planar surface. The bottle handle further includes a second reinforcement rib protruding from and extending along the second planar surface. The first reinforcement rib is misaligned with the second reinforcement rib along a direction extending parallel to the first planar surface and the second planar surface.

Other aspects of the disclosure will become apparent by consideration of the detailed description and accompanying drawings.

Before any embodiments of the disclosure are explained in detail, it is to be understood that the disclosure is not limited in its application to the details of construction and the arrangement of components set forth in the following description or illustrated in the following drawings. The disclosure is capable of supporting other embodiments and of being practiced or of being carried out in various ways.

DETAILED DESCRIPTION

Figure 1:
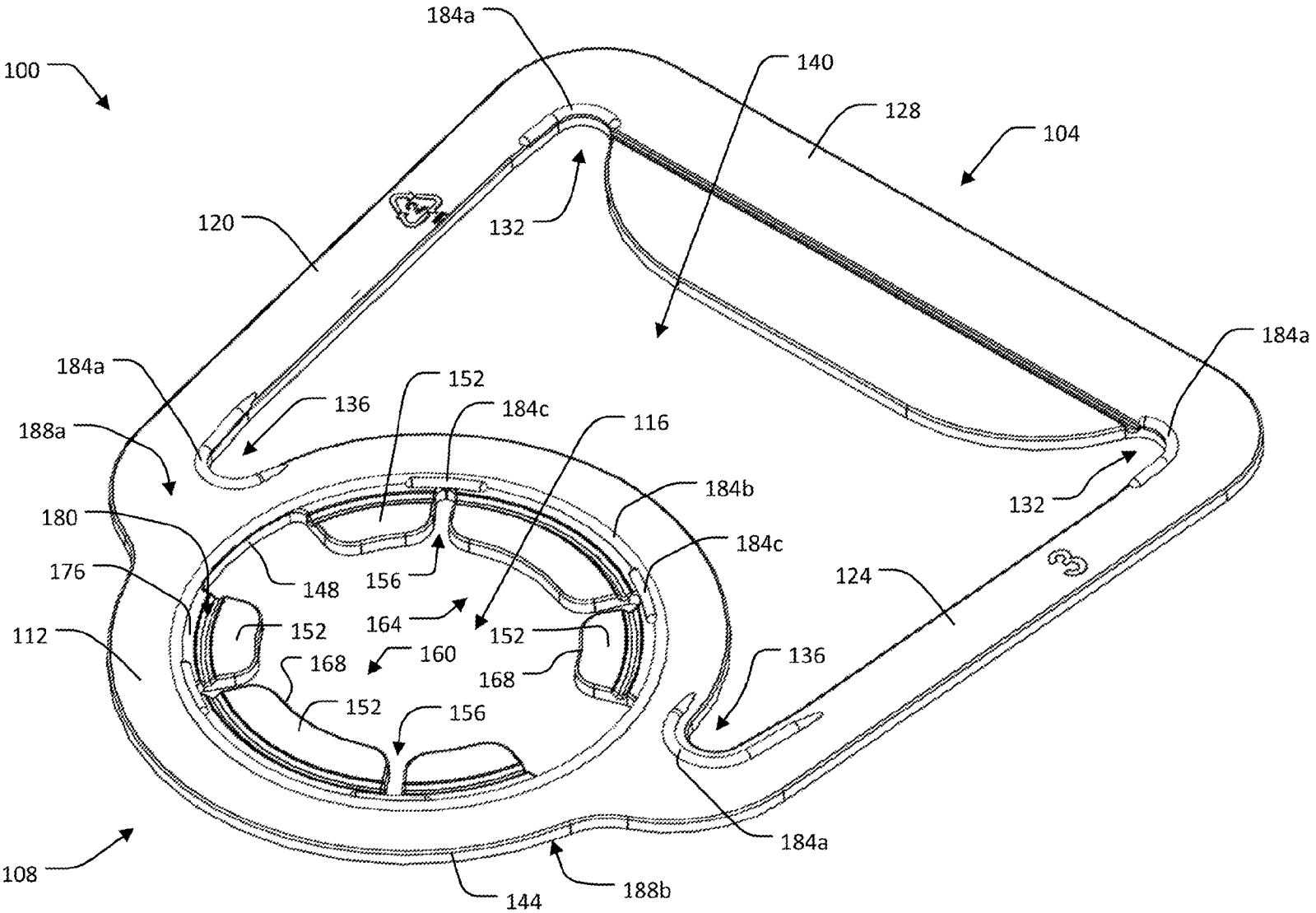
FIG. 1 is a perspective view of an embodiment of a handle for a bottle, such as the bottle shown in FIG. 7.

The present disclosure illustrates a handle 100 (FIG. 1) that couples to a container 200 (FIG. 7) to facilitate carrying the container. The container 200 illustrated in the figures is a bottle 200, and further an approximately one-gallon bottle. It should be appreciated that a bottle 200, and specifically a one-gallon bottle is provided for purposes of illustration and is not limiting. The handle 100 can be used in association with any type of suitable container or vessel, or any size of suitable bottle that benefits from being carried by the handle 100.

Figure 7:
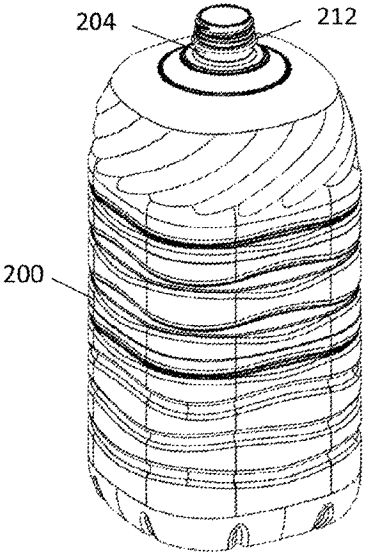
FIG. 7 is a perspective view of an embodiment of a bottle.
Figure 9:
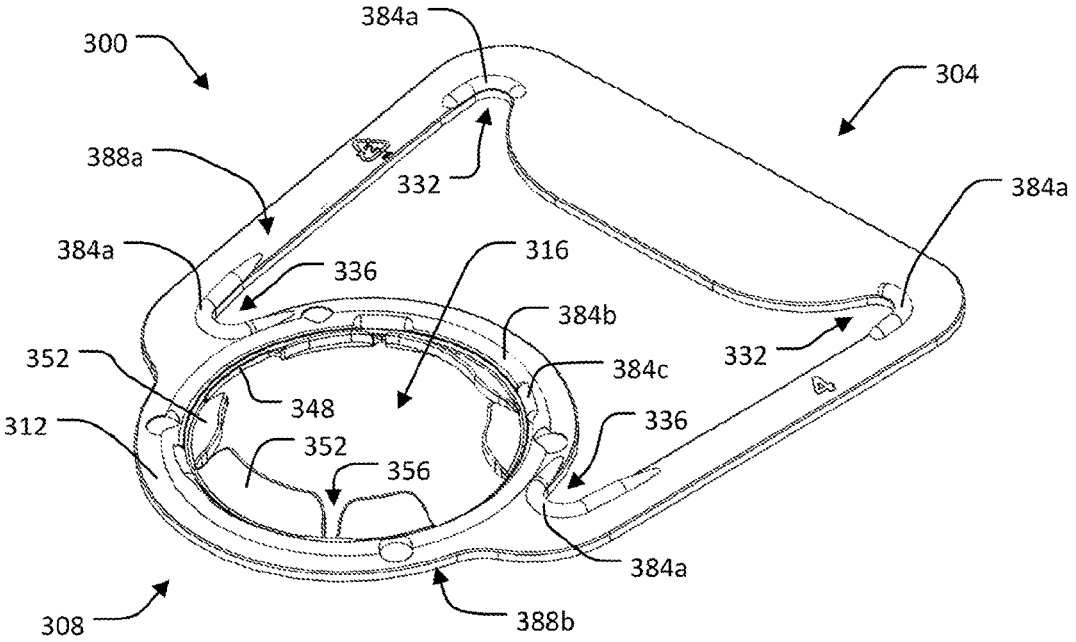
FIG. 9 is a perspective view of another embodiment of a handle for a bottle, such as the bottle shown in FIG. 7.
Figure 10:
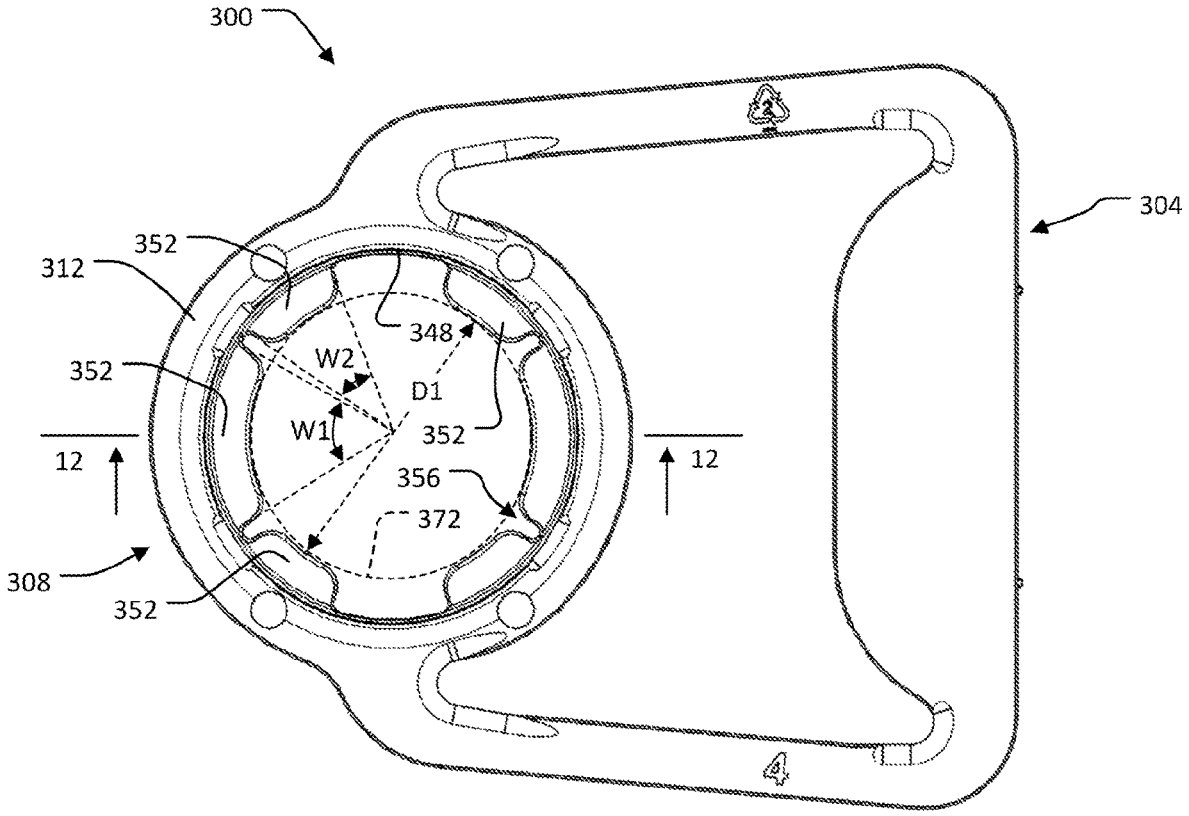
FIG. 10 is a top plan view of the handle shown in FIG. 9.
Figure 11:
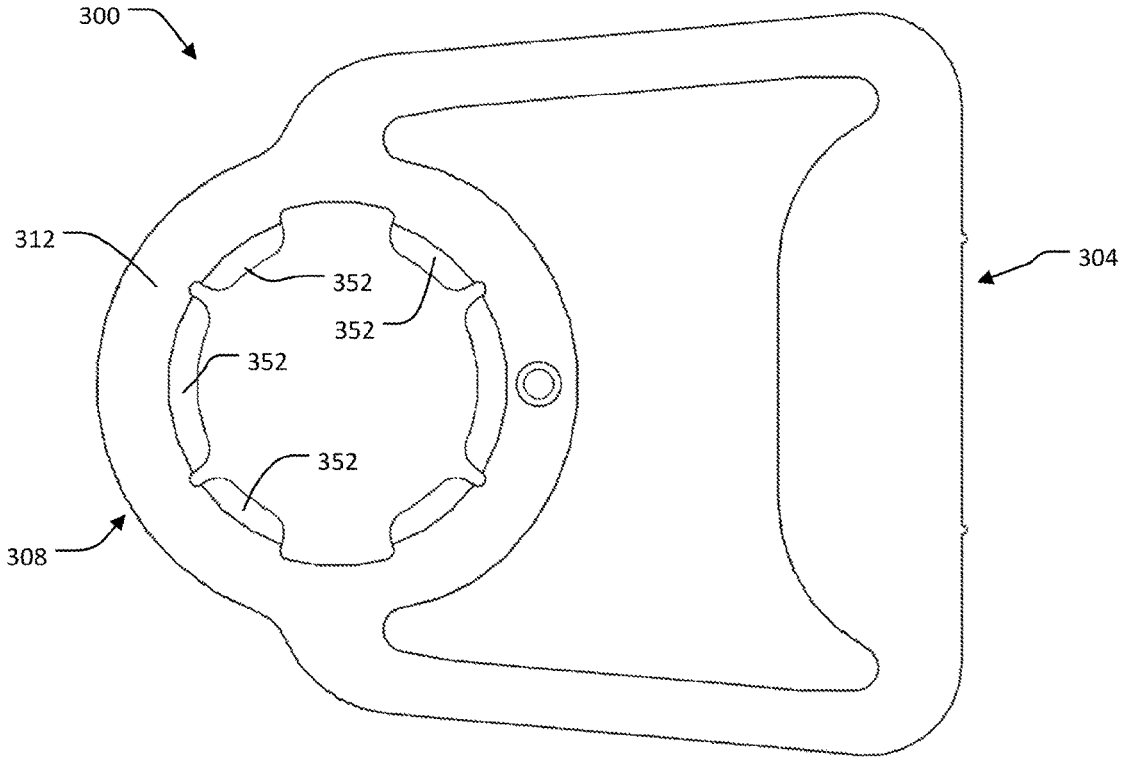
FIG. 11 is a bottom plan view of the handle shown in FIG. 9.

With reference to FIGS. 1-4, in its normal state the handle 100 lies generally flat or in a horizontal plane. The handle 100 includes a handle portion 104 that can be grasped by the user to facilitate carrying the bottle 200 (FIG. 7). The handle 100 also includes a neck engagement collar 108 connected to the handle portion 104 for receiving and engaging a neck 204 of the bottle 200. The collar 108 includes a neck ring 112 that defines a central neck aperture 116. The neck aperture 116 receives a neck 204 of the bottle 200 when the handle 100 is coupled to the bottle 200.

The handle portion 104 includes a pair of arms including a first elongated arm 120 and a second elongated arm 124 that extend away from opposite ends of the collar 108 in a substantially similar direction but diverging slightly away from one another. The handle portion 104 also includes a cross-member 128 that connects the distal ends of the two arms 120, 124. Arcuate first corners 132 are formed with the cross-member 128 and each arm 120, 124, and arcuate second corners 136 are formed with the neck ring 112 and each arm 120, 124. The cross-member 128 connects to the elongated arms 120, 124 at an end opposite to where the arms 120, 124 each connect to the neck ring 112. The opposing elongated arms 120, 124 and the cross-member 128, with a portion of the neck ring 112, collectively define a handle aperture 140. A user can utilize the handle portion 104 to grasp and carry an attached bottle 200. For example, the user can grasp the cross-member 128 alone, or in combination with a portion of one of the arms 120, 124. The user can then position fingers and a portion of a hand through the handle aperture 140. In other embodiments, a user can grasp one of the arms 120, 124 alone, or in combination with a portion of the cross-member 128.

The neck ring 112 is illustrated as an annular ring, but in other embodiments can be any suitable shape (e.g., triangular, square, rectangular, etc.). The neck ring 112 includes a first, outer circumference 144 (or an outer perimeter 144) and a second, inner circumference 148 (or an inner perimeter 148). The neck aperture 116 is bordered by the inner circumference 148 such that the inner circumference 148 defines a boundary of the neck aperture 116. A plurality of neck engagement tabs 152 are positioned on the neck ring 112. The tabs 152 radially extend from the neck ring 112 into a portion of the neck aperture 116 (or towards a center of the neck aperture 116). The tabs 152 are positioned around a portion of the neck ring 112. Stated another way, the tabs 152 are not positioned around the entire inner circumference 148. Adjacent pairs of the tabs 152 define slots 156 therebetween. The slots 156 extend radially from the neck aperture 116 and terminate at the neck ring 112.

With continued reference to FIGS. 1-4, a first grouping of tabs 160 is separated (or spaced) from a second grouping of tabs 164. Each grouping of tabs 160, 164 includes a plurality of tabs 152. More specifically, each grouping of tabs 160, 164 includes three tabs 152. Thus, the total number of tabs 152 in the illustrated embodiment includes at least six total tabs 152. The groupings of tabs 160, 164 are positioned on opposing sides of the neck ring 112. Each grouping of tabs 160, 164 is spaced by a portion of the inner circumference 148 of the neck ring 112 that does not include any tabs 152 (or is tabless). However, in other embodiments, each grouping of tabs 160, 164 can include any suitable number of tabs 152 suitable to form a plurality of tabs 152. In addition, in other embodiments, the neck ring 112 can include a plurality of groupings of tabs (e.g., at least two, three, or four or more groupings). In other examples of embodiments, the neck ring 112 can include at least eight tabs, at least ten tabs, at least twelve tabs, at least fourteen tabs 152, or fourteen or more tabs.

Figure 4:
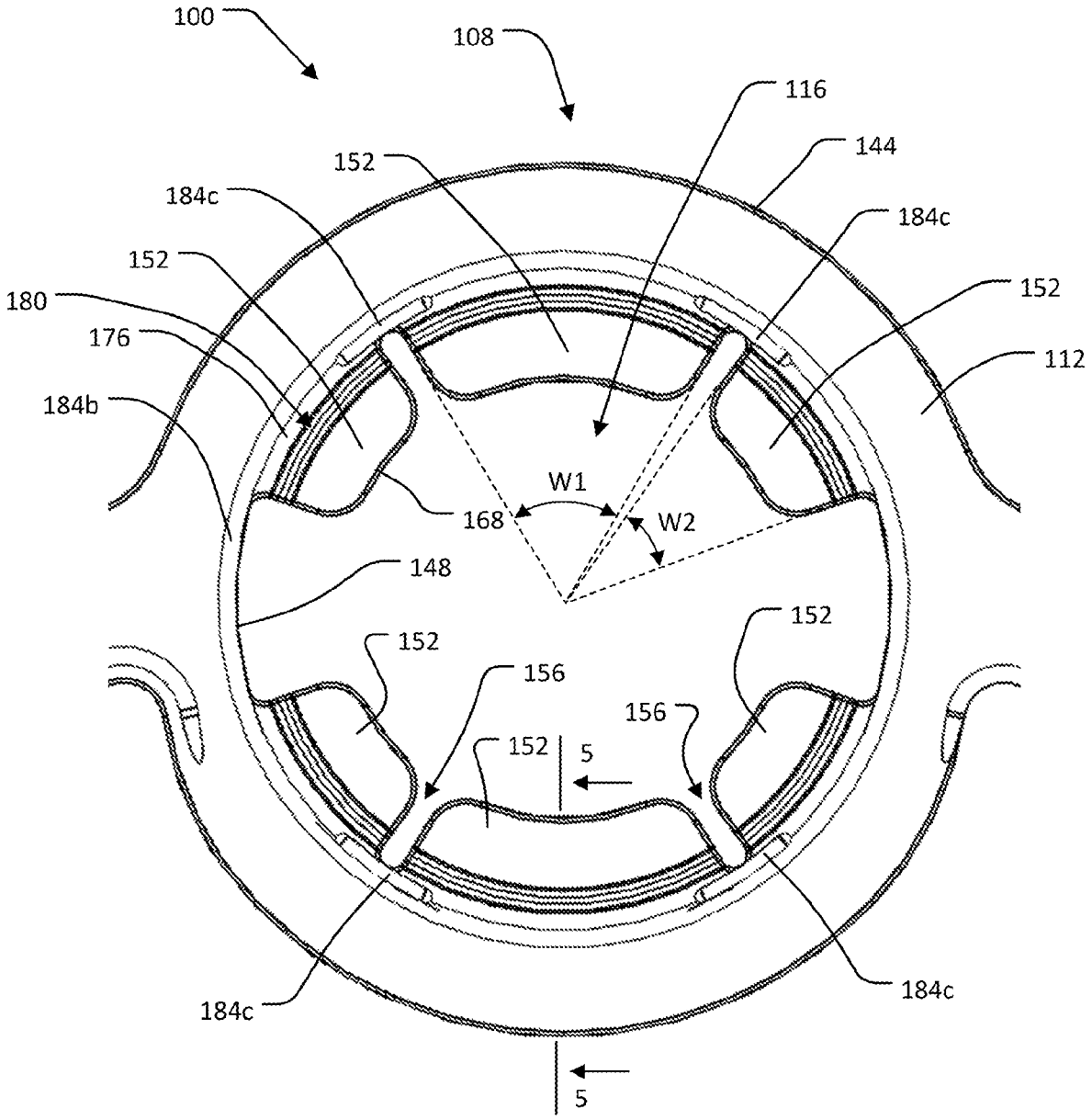
FIG. 4 is a top plan view of a neck engagement collar of the handle shown in FIG. 1.

With reference to FIG. 4, each tab 152 includes an angular width by which the tab 152 extends about the inner circumference 148 of the neck ring 112. In the illustrated embodiment, the tabs 152 can have different angular widths. For example, a central tab 152 in each grouping of tabs 160, 164 can include a first angular width $W_1$ and the outer tabs 152 in each grouping of tabs 160, 164 can include a second angular width $W_2$. In the illustrated embodiment, the first angular width $W_1$ is greater than the second angular width $W_2$. The first angular width $W_1$ can be between 45 degrees and 75 degrees, or approximately 60 degrees. The second angular width $W_2$ can be between 15 degrees and 45 degrees, or approximately 30 degrees. In other embodiments, each tab 152 can include the same angular width.

Figure 2:
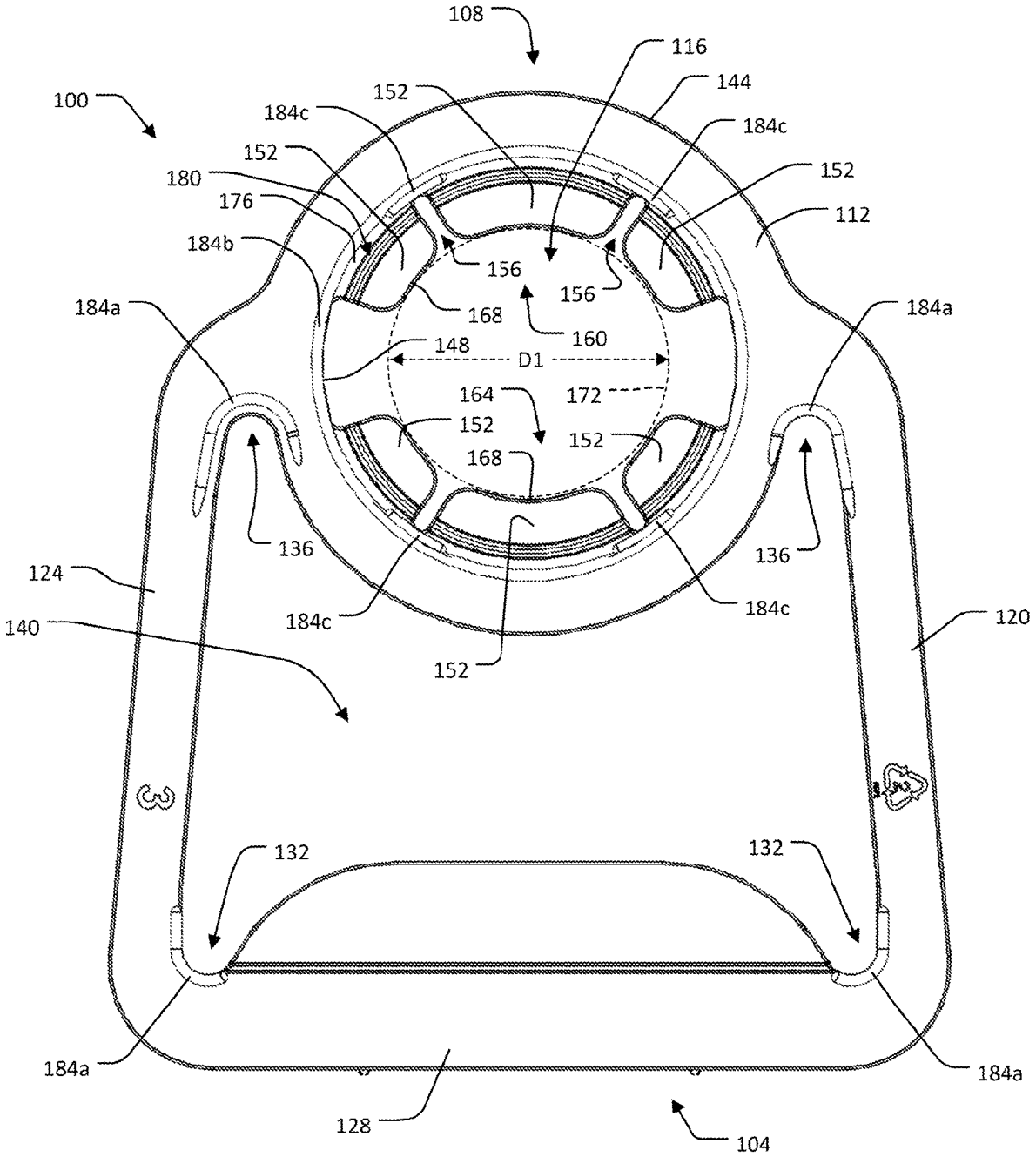
FIG. 2 is a top plan view of the handle shown in FIG. 1.
Figure 3:
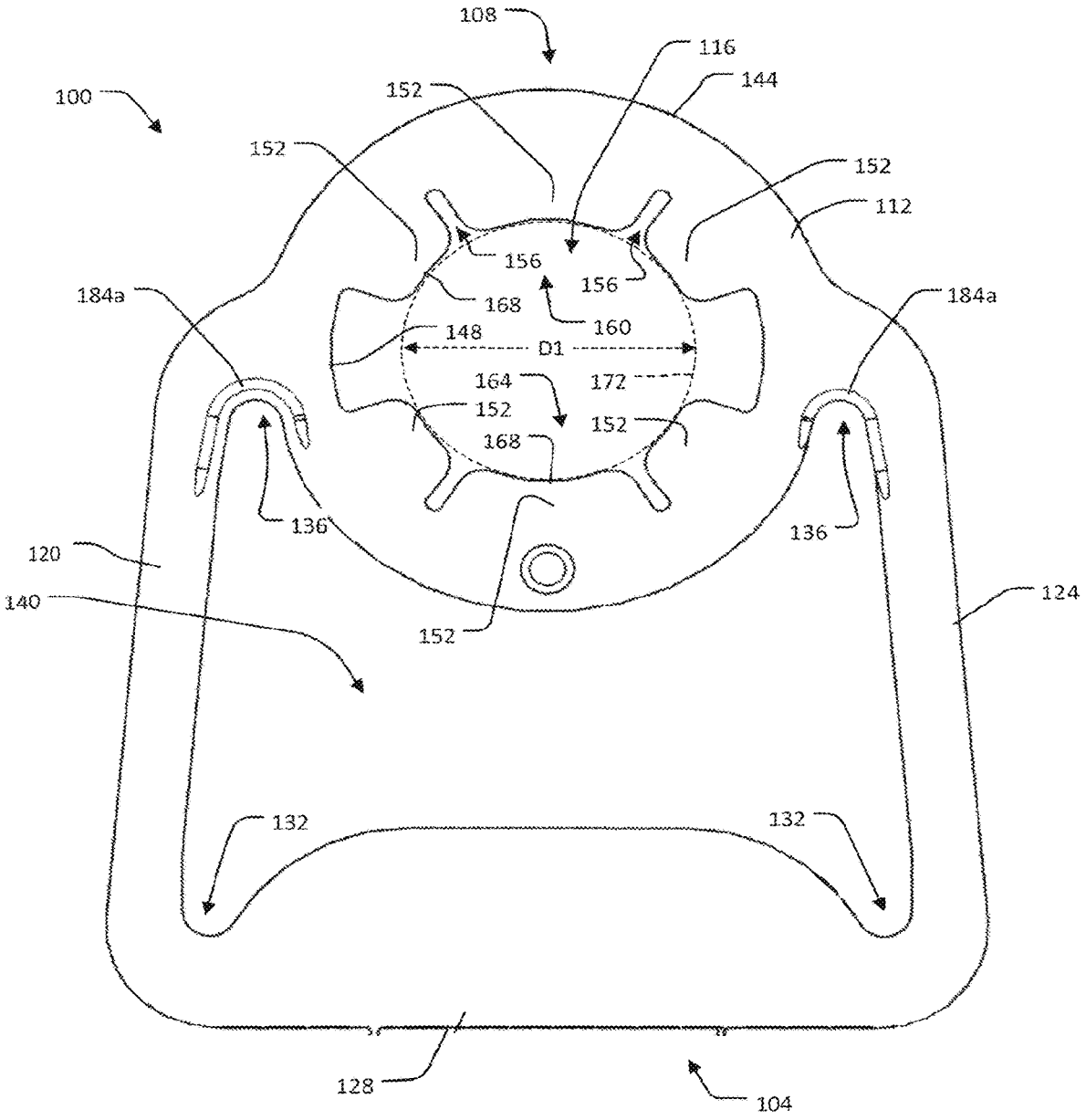
FIG. 3 is a bottom plan view of the handle shown in FIG. 1.

Referring again to FIG. 2, the tabs 152 include radially innermost tip edges 168 that cooperate to define a circular region 172 of the neck aperture 116. The circular region 172 includes an aperture diameter D1 measured between the tip edges 168 of two circumferentially-opposite tabs 152. The neck 204 of the bottle 200 (FIG. 7) includes a neck diameter D2 (FIG. 8) that, in the illustrated embodiment, is greater than the aperture diameter D1 of the circular region 172. An interference of the collar 108 is defined as a difference of the neck diameter D2 and the aperture diameter D1 (FIG. 2). In the illustrated embodiment, the interference is 0.71 millimeters (mm). In other embodiments, the interference can be 0.21 mm, or between 0.05 mm and 0.95 mm, or greater than 0.71 mm. Due to the interference, the tabs 152 slightly deflect or bend when the collar 108 is fitted about the neck 204. The aperture diameter D1 can be increased or decreased to adjust the interference.

Figure 8:
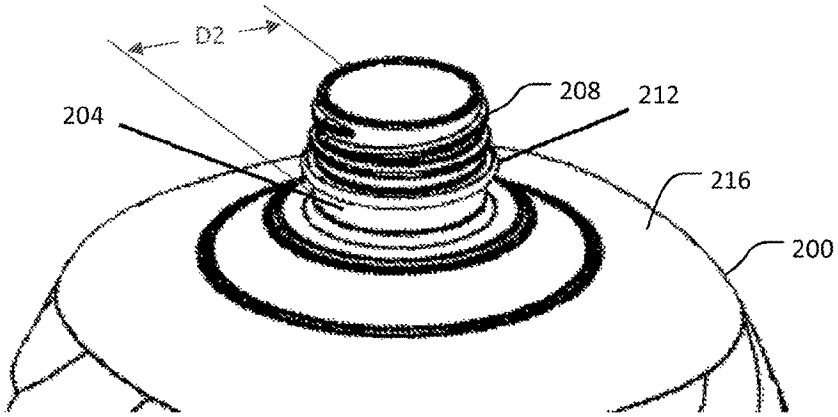
FIG. 8 is a detail view of a portion of the bottle shown in FIG. 7.
Figure 5:
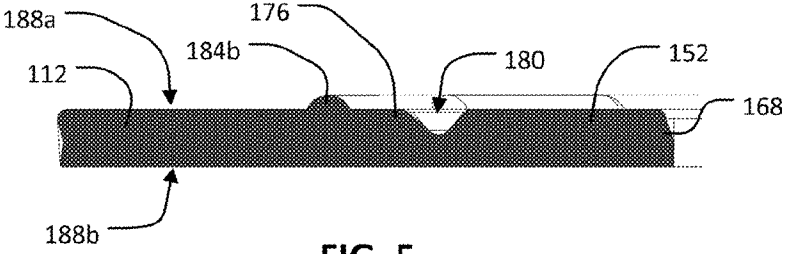
FIG. 5 is a cross-sectional view of the handle of FIG. 1, taken through line 5-5 of FIG. 4.

With reference to FIGS. 7 and 8, the bottle 200 includes a finish 208 coupled to the neck 204. The finish 208 is configured to receive a closure (e.g., such as a cap; not shown). An annular flange or support ledge, such as support ledge 212, circumferentially extends around the neck 204 and is positioned between the finish 208 and the neck 204. With reference to FIGS. 2-5, a base 176 of each tab 152 is located adjacent the neck ring 112 and defines an annular groove 180 that enables the tab 152 to more easily bend in the region of the groove 180. The groove 180 enables the tabs 152 to flex so that the collar 108 can slip down over the support ledge 212 as the collar 108 is pushed onto the neck 204 of the bottle 200.

Figure 6:
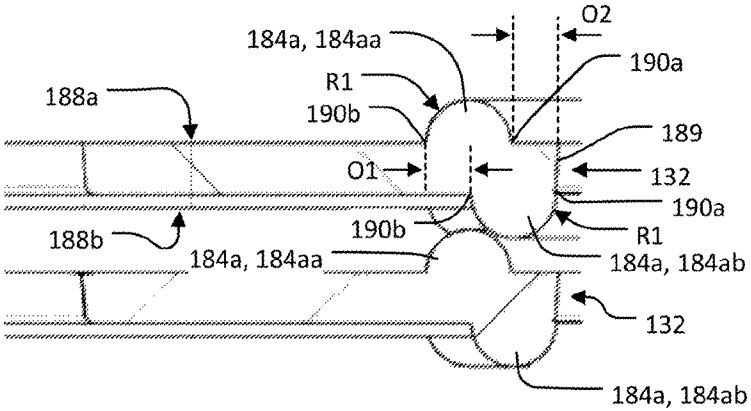
FIG. 6 is a cross-sectional view two of the handles shown in FIG. 1 stacked upon one another, taken through a handle portion of the handles.

With reference to FIGS. 1-6, the handle 100 includes reinforcement ribs that extend at least partially around the four corners 132, 136 of the handle portion 104 and around all or portions of the collar 108. As illustrated in FIGS. 1-3 and 6, corner reinforcement ribs 184*a* extend around the four corners 132, 136 of the handle portion 104 and are positioned on each of a first side surface 188*a* and a second side surface 188*b* of the handle 100. In the illustrated embodiment, each corner reinforcement rib 184*a* is approximately 1 mm in height as measured from the first side surface 188*a* or the second side surface 188*b* to the top of the rib 184*a*. The corner reinforcement ribs 184*a* increase strength in potential failure areas of the handle 100. As shown in FIG. 6, first corner reinforcement ribs 184*aa* positioned on the first side surface 188*a* of the handle 100 are misaligned with second corner reinforcement ribs 184*ab* positioned on the second side surface 188*b*, respectively. More specifically, the corner reinforcement ribs 184*aa* on the first side surface 188*a* are offset from an inside face 189 of the first or second corners 132, 136, respectively, by a different distance than the corner reinforcement ribs 184*a* on the second side surface 188*b* are offset from the inside face 189. The offset geometry of the corner reinforcement ribs 184*aa*, 184*bb* between the two side surfaces 188*a*, 188*b* allows for improved stacking of multiple handles 100. More specifically, the offset geometry of the corner reinforcement ribs 184*aa*, 184*ab* allows for the stacked handles 100 to nest, allowing for more handles 100 to be stacked in the machine that installs each handle 100 on the bottle 200.

FIG. 6 illustrates a cross-sectional view of the second corner 136 taken through a cutting plane perpendicular to the first and second side surfaces 188*a*, 188*b*. As shown in FIG. 6, each corner reinforcement rib 184*a* is semicircular in cross-section and has a constant radius of curvature R1 between an inner corner 190*a* and an outer corner 190*b*. The inner and outer corners 190*a*, 190*b* are each defined between the corner reinforcement rib 184*a* and the first or second side surface 188*a*, 188*b*, respectively. The inner corners 190*a* of each corner reinforcement rib 184*a* are located nearest to the inside face 189 and the outer corners 190*b* are located farthest from the inside face 189. As shown in FIG. 6, a first offset O1 between the corner reinforcement ribs 184*aa*, 184*ab* may be measured between the respective outer corners 190*b* of each corner reinforcement rib 184*aa*, 184*ab* along a direction parallel to the first and second side surfaces 188*a*, 188*b*. In the illustrated embodiment, the first offset O1 is greater than the radius of curvature R1. In other embodiments, the first offset O1 can be equal to or greater than the radius of curvature R1. In further embodiments, the first offset O1 can be greater than or equal to the radius of curvature R1, but less than or equal to twice the radius of curvature R1 (i.e., R1≤O1≤2R1). In such embodiments, the corner reinforcement ribs 184*aa*, 184*ab* are offset or misaligned from one another to improve stackability but remain in close proximity to one another and to the second corner 136. As further shown in FIG. 6, the corner reinforcement rib 184*ab* is positioned directly adjacent the inside face 189, such that the curvature of the rib 184*ab* smoothly transitions to the inside face 189. A second offset O2 between the corner reinforcement ribs 184*aa*, 184*ab* may be measured between the inside face 189 and the inner corner 190*a* of the first corner reinforcement rib 184*aa* along the direction parallel to the first and second side surfaces 188*a*, 188*b*. In the illustrated embodiment, the second offset O2 is greater than or equal to the radius of curvature R1.

With reference to FIGS. 1, 2, 4, and 5, a collar reinforcement rib 184*b* protrudes from the first side surface 188*a* of the collar 108 and extends continuously around a circumference of the neck aperture 116. In addition, slot reinforcement ribs 184*c* are positioned adjacent the slots 156 defined between the neck engagement tabs 152. One slot reinforcement rib 184*c* is positioned adjacent each respective slot 156, such that a number of the slot reinforcement ribs 184*c* is equal to a number of the slots 156. Each slot reinforcement rib is formed as an arcuate segment extending about a portion of the circumference of the neck aperture 116. The collar reinforcement rib 184*b* surrounds each of the slot reinforcement ribs 184*c*. As such, each slot reinforcement rib 184*c* is positioned between its respective slot 156 and the collar reinforcement rib 184*b* in the radial direction. The collar reinforcement rib 184*b* and the slot reinforcement ribs 184*c* are positioned on only the first side surface 188*a* of the collar 108. Specifically, the ribs 184*b*, 184*c* are positioned on the first side surface 188*a*, which faces toward the support ledge 212 and away from a bell 216 of the bottle 200 when the handle 100 is installed on the neck 204. From the perspective of a user carrying the handle 100 with the bottle 200 attached, the ribs 184*b*, 184*c* will be visible when the handle 100 is installed on the bottle 200 as they will face toward the user and away from the bottle 200.

In the illustrated embodiment, the handle 100 is formed by injection molding a resin material (e.g., plastic). The handle 100 can be molded as a unitary assembly including all of the described components. In other embodiments, the handle 100 can be manufactured using multiple-step injection molding, can molded by multi-material injection molding, or can be manufactured by any other suitable production process. In other embodiments, The handle assembly 100 can be manufactured by die cutting (or punch cutting), or by any other suitable production process.

The handle 100 can be formed of high-density polyethylene (or HDPE). The HDPE can be the same grade used to form a bottle closure. In other embodiments, the HDPE can be a different grade than the bottle closure. For example, the HDPE can have improved strength properties, such as a greater tensile strength in order to provide improved strength and durability while a user grasps and carries an associated bottle 200 by the handle portion 104. In other embodiments, the handle 100 can be formed of any suitable thermoplastic polymer (e.g., polyethylene (PE), low-density polyethylene (LDPE), polyethylene terephthalate (PET), polypropylene (PP), polyvinyl chloride (PVC), polycarbonate (PC), and the like), any suitable bio-based polymer (e.g., polylactic acid (PLA), polyhydroxyalkanoates (PHA), and the like), any suitable material, or can be formed of a plurality of materials (e.g., by multi-material injection molding, etc.).

The handle 100 is configured to slide over the closure (not shown) and the support ledge 212 to engage the neck 204. For example, the closure is received by the neck aperture 116 of the neck engagement collar 108 of the handle 100. A downward force is applied to the handle 100, for example by equipment designed to install the handle 100 onto the bottle 200. The collar 108 slides along closure such that the closure is received by the neck aperture 116. The plurality of tabs 152 are configured to bend relative to the neck ring 112 to allow the support ledge 212 to pass through the neck aperture 116. The neck 204 is then received by the neck aperture 116. The plurality of tabs 152 actuate back toward an unbent position to engage the neck 204, but remain slightly deflected due to the interference defined between the neck diameter D2 and the aperture diameter D1. The support ledge 212 is positioned on a closure side of the collar 108. The support ledge 212 contacts a portion of the plurality of tabs 152 to assist with maintaining engagement of the tabs 152 with the neck 204. Stated another way, the support ledge 212 assists to restrict sliding disengagement of the tabs 152 from the neck 204.

FIGS. 9-12 illustrate a handle 300 that couples to the container 200 (FIG. 7) to facilitate carrying the container according to another embodiment of the present disclosure. The handle 300 is similar to the handle 100 and includes generally the same structure as the handle 100. Accordingly, the following description focuses primarily on the structure and features that are different from the embodiments described above in connection with FIGS. 1-6. Features of the handle 300 that correspond to features of the handle 100 already described herein are assigned the same reference numerals plus "200."

Like the handle 100, the handle 300 lies generally flat or in a horizontal plane and includes a handle portion 304 and a neck engagement collar 308 connected to the handle portion 304 for receiving and engaging the neck 204 of the bottle 200. The handle portion 304 includes first corners 332 and second corners 336. Corner reinforcement ribs 384*a* extend around the four corners 332, 336 and are positioned on only the first side surface 388*a*, and not on the second side surface 388*b*. In the illustrated embodiment, each corner reinforcement rib 384*a* is approximately 1 mm in height as measured from the surface of the handle portion 304 to the top of the rib 384*a*.

The collar 308 includes a neck ring 312 that defines a central neck aperture 316. The neck aperture 316 receives the neck 204 of the bottle 200 when the handle 300 is coupled to the bottle 200. The neck ring 312 includes an inner circumference 348, and a plurality of neck engagement tabs 352 radially extend from the neck ring 312 into a portion of the neck aperture 316 (or towards a center of the neck aperture 316). The tabs 352 are arranged into two groupings each having, in the illustrated embodiment, three tabs 352. Thus, the total number of tabs 352 in the illustrated embodiment includes at least six total tabs 352. A central tab 352 in each grouping of tabs can include a first angular width $W_1$ and the outer tabs 352 in each grouping of tabs can include a second angular width $W_2$. In the illustrated embodiment, the first angular width $W_1$ is greater than the second angular width $W_2$. The first angular width $W_1$ can be between 45 degrees and 75 degrees, or approximately 60 degrees. The second angular width $W_2$ can be between 15 degrees and 45 degrees, or approximately 30 degrees. In other embodiments, each tab 352 can include the same angular width.

Figure 12:
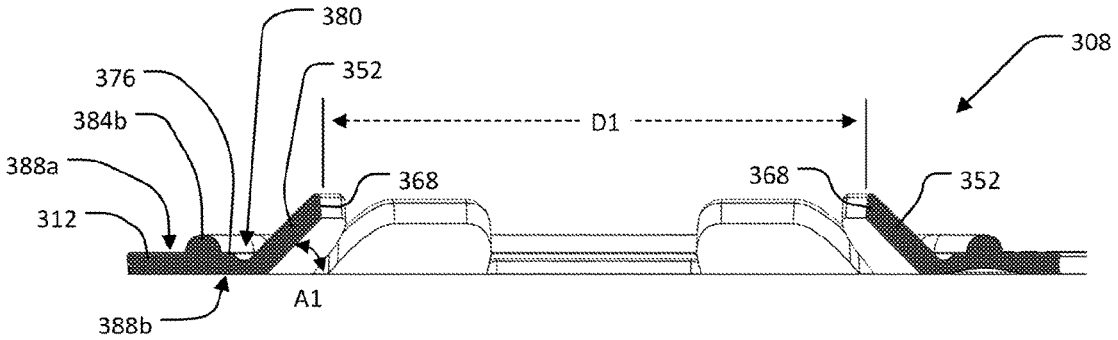
FIG. 12 is a cross-sectional view of the handle shown in FIG. 9, taken through line 11-11 of FIG. 10.

With reference to FIG. 12, the tabs 352 are molded to be sloped (or angled). In the illustrated embodiment, the tabs 352 are sloped toward the first side surface 388*a*. As such, the tabs 352 are angled toward the support ledge 212 when the collar 308 is attached to the neck 204 of the bottle 200. Stated differently, the tabs 352 are angled away from the direction of installation onto the neck 204. The tabs 352 can be angled to reduce the force required to install the handle 300 onto the neck 204 of the bottle 200. The tabs 352 diverge away from the planar second side surface 388*b* by a slope angle A1. In the illustrated embodiment, the slope angle A1 is 45 degrees. In other embodiments (not shown), the slope angle can be between 5 degrees and 70 degrees, or between 30 degrees and 60 degrees, or between 40 degrees and 60 degrees, or greater than 5 degrees.

The tabs 352 include radially innermost tip edges 368 that cooperate to define a circular region 372 of the neck aperture 316. The circular region 372 includes an aperture diameter D1 measured between the tip edges 368 of two circumferentially-opposite tabs 352. An interference of the collar 308 is defined as a difference of the neck diameter D2 of the bottle 200 and the aperture diameter D1 (FIG. 12). In the illustrated embodiment, the interference is 0.71 millimeters (mm). In other embodiments, the interference can be 0.21 mm, or between 0.05 mm and 0.95 mm, or greater than 0.71 mm. Due to the interference, the tabs 352 slightly deflect or bend when the collar 308 is fitted about the neck 204. The aperture diameter D1 can be increased or decreased to adjust the interference.

Like the handle 100, the handle 300 includes a collar reinforcement rib 384*b* protrudes from the first side surface 388*a* of the collar 308 and extends continuously around a circumference of the neck aperture 316. In addition, slot reinforcement ribs 384*c* are positioned adjacent the slots 356 defined between the neck engagement tabs 352.

Figure 13:
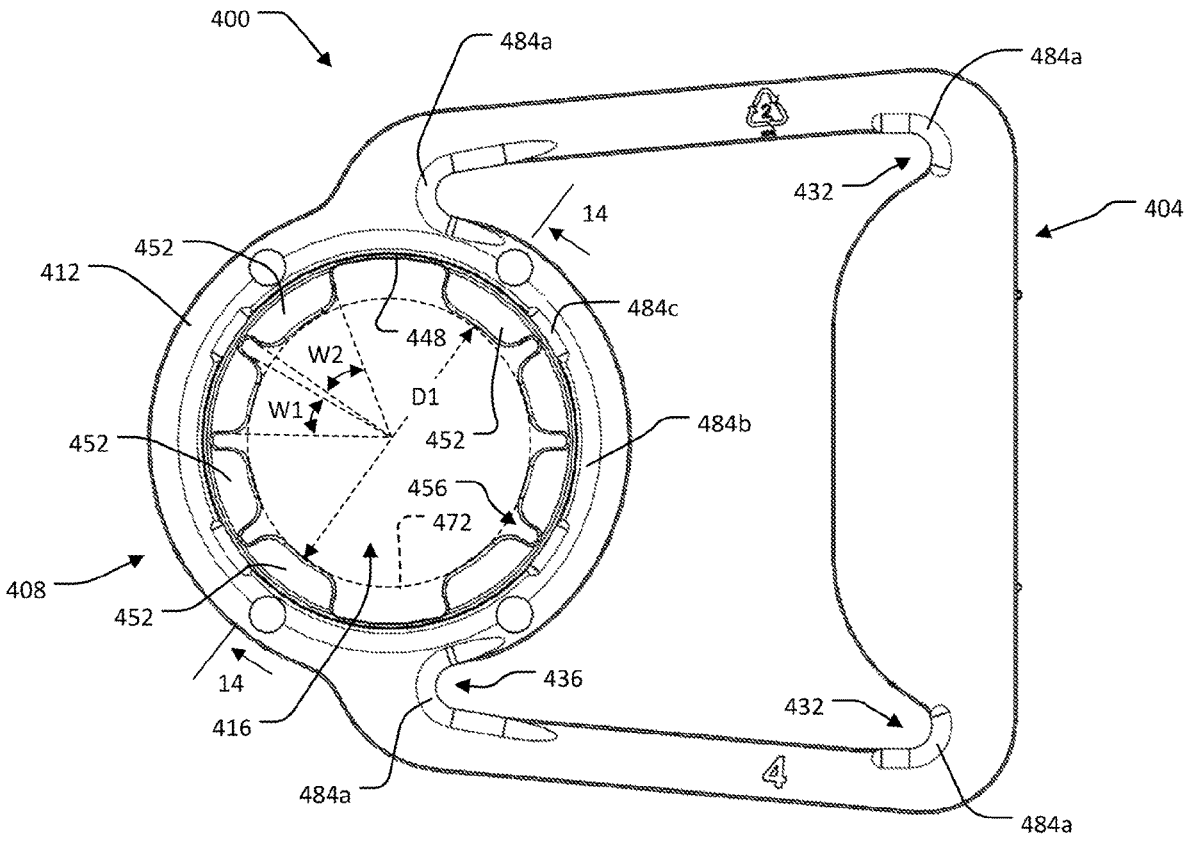
FIG. 13 is a top plan view of another embodiment of a handle for a bottle, such as the bottle shown in FIG. 7.
Figure 14:
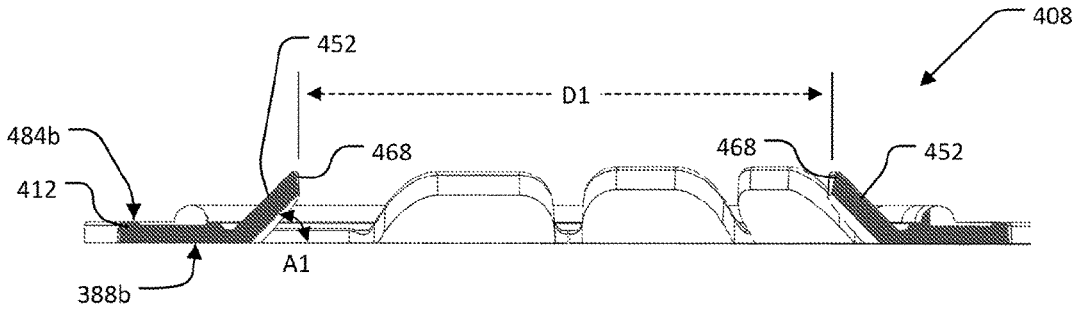
FIG. 14 is a cross-sectional view of the handle shown in FIG. 13, taken through line 14-14 of FIG. 13.

FIGS. 13 and 14 illustrate a handle 400 that couples to the container 200 (FIG. 7) to facilitate carrying the container according to another embodiment of the present disclosure. The handle 400 is similar to the handle 300 and includes generally the same structure as the handle 300. Accordingly, the following description focuses primarily on the structure and features that are different from the embodiments described above in connection with FIGS. 9-12. Features of the handle 400 that correspond to features of the handle 300 already described herein are assigned the same reference numerals plus "100."

The handle 400 includes a plurality of neck engagement tabs 452 arranged into two groupings each having, in the illustrated embodiment, four tabs 452. Thus, the total number of tabs 452 in the illustrated embodiment includes at least eight total tabs 452. The two central tabs 452 in each grouping of tabs can include a first angular width $W_1$ and the two outer tabs 452 in each grouping of tabs can include a second angular width $W_2$. In the illustrated embodiment, the first angular width $W_1$ is less than the second angular width $W_2$. The first angular width $W_1$ can be between 15 degrees and 45 degrees, or approximately 30 degrees. The second angular width $W_2$ can be between 20 degrees and 50 degrees, or approximately 35 degrees. In other embodiments, each tab 452 can include the same angular width.

With reference to FIG. 14, the tabs 452 are molded to be sloped (or angled). In the illustrated embodiment, the tabs 452 are sloped toward the first side surface 488*a*. As such, the tabs 452 are angled toward the support ledge 212 when the collar 408 is attached to the neck 204 of the bottle 200. Stated differently, the tabs 452 are angled away from the direction of installation onto the neck 204. The tabs 452 can be angled to reduce the force required to install the handle 400 onto the neck 204 of the bottle 200. The tabs 452 diverge away from the planar second side surface 488*b* by a slope angle A1. In the illustrated embodiment, the slope angle A1 is 45 degrees. In other embodiments (not shown), the slope angle can be between 5 degrees and 70 degrees, or between 30 degrees and 60 degrees, or between 40 degrees and 60 degrees, or greater than 5 degrees.

The tabs 452 include radially innermost tip edges 468 that cooperate to define a circular region 472 of the neck aperture 416. The circular region 472 includes an aperture diameter D1 measured between the tip edges 468 of two circumferentially-opposite tabs 452. An interference of the collar 408 is defined as a difference of the neck diameter D2 of the bottle 200 and the aperture diameter D1 (FIG. 12). In the illustrated embodiment, the interference is 0.71 millimeters (mm). In other embodiments, the interference can be 0.21 mm, or between 0.05 mm and 0.95 mm, or greater than 0.71 mm. Due to the interference, the tabs 452 slightly deflect or bend when the collar 408 is fitted about the neck 204. The aperture diameter D1 can be increased or decreased to adjust the interference.

Like the handle 300, the handle 400 includes a collar reinforcement rib 484*b* protrudes from the first side surface 488*a* of the collar 408 and extends continuously around a circumference of the neck aperture 416. In addition, slot reinforcement ribs 484*c* are positioned adjacent the slots 456 defined between the neck engagement tabs 452.

While FIGS. 1-14 illustrate some embodiments of the handles 100, 300, and 400, in other embodiments the handle can include alternative configurations. For example, the handle can include a configuration with a plurality of neck engagement collars. In one embodiment, the handle can include a first neck engagement collar spaced from a second neck engagement collar by the handle portion. In this embodiment, the handle assembly can be configured to facilitate carrying of a plurality of bottles 200, as each neck engagement collar can engage a separate bottle 200. In another embodiment, the handle can include four neck engagement collars interconnected by the handle portion. The four neck engagement collars can be arranged in a row, can be arranged in a square arrangement, can be arranged in a rectangular arrangement, or can be arranged in any suitable or desired arrangement. Each neck engagement collar can engage a separate bottle 200. In another embodiment, the handle can include six neck engagement collars interconnected by the handle portion. The six neck engagement collars can be arranged in a row, can be arranged in a hexagon arrangement, can be arranged in a rectangular arrangement, or can be arranged in any suitable or desired arrangement. In other embodiments, the handle can include two, three, four, five, six, or seven or more neck engagement collars to facilitate carrying of a plurality of bottles 200. The neck engagement collars are connected (or interconnected) to at least one handle portion (or a plurality of handle portions) to facilitate the carrying of the plurality of bottles 200. The neck engagement collars can be arranged in any suitable or desired orientation relative to the handle portion, or to each other.

One or more aspects of the handles 100, 300, 400 provide certain advantages. For example, the unique geometry, numbering, and/or positioning of the tabs 152, 352, 452 of the neck rings 112, 312, 412 assist with providing easier installation of each handle 100, 300, 400 onto the bottle 200. In addition, the reinforcement ribs 184*a*-184*c*, 384*a*-384*c*, 484*a*-484*c* increase strength in potential failure areas of the handles 100, 300, 400. These and other advantages are realized by the disclosure provided herein.

Examples of material from which the handles 100, 300, 400 may be comprised include, e.g., DOWLEX™ IP-10 HDPE, EVERCAP™ DMDC-1210 HDPE, DOW™ DMDA-8007 HDPE, INEOS™ T60-800 HDPE, INEOS™ T60-500 HDPE, INEOS™ J50-1000-178 HDPE, INEOS™ CAP508 HDPE, INEOS™ H12Z-03 Polypropylene, SURPASS® CCs757A HDPE, SURPASS® CCs154 HDPE, and the like.

Various features of the disclosure are set forth in the following claims.

What is claimed is:

1. A bottle handle comprising:

a neck engagement collar including a neck ring defining a central aperture;

a handle portion coupled to the neck engagement collar, the handle portion including a first arm and a second arm each extending from opposite ends of the neck ring such that a first arcuate corner is formed with the neck ring and the first arm and a second arcuate corner is formed with the neck ring and the second arm;

a first reinforcement rib extending at least partially around the first arcuate corner on a first surface adjoining the neck ring with the first arm; and a second reinforcement rib extending at least partially around the second arcuate corner on a second surface, the second surface adjoining the neck ring with the second arm, and wherein the first reinforcement rib is positioned a first distance from the first arcuate corner and the second reinforcement rib is positioned a second offset distance from the second arcuate corner greater than the first distance.

2. The bottle handle of claim 1, further including a plurality of tabs extending radially inward from the neck ring;

wherein two adjacent tabs of the plurality of tabs define a slot therebetween, and wherein a third reinforcement rib protrudes from the neck ring and is located adjacent the slot.

3. The bottle handle of claim 2, wherein the slot comprises a plurality of slots and the third reinforcement rib comprises a plurality of reinforcement ribs protruding from the neck ring, and wherein a number of the reinforcement ribs protruding from the neck ring is equal to a number of the slots.

4. The bottle handle of claim 2, wherein the third reinforcement rib is arcuate and extends about only a portion of a circumference of the central aperture.

5. The bottle handle of claim 2, further including fourth reinforcement rib protruding from the neck ring and extending continuously around all of a circumference of the central aperture.

6. The bottle handle of claim 1, wherein each of the first reinforcement rib and the second reinforcement rib is semicircular in cross-section and each has a radius of curvature in cross-section, and wherein the offset distance is greater than or equal to the radius of curvature.

7. The bottle handle of claim 1, wherein the handle portion further includes a gripping portion that connects distal ends of the first arm and the second arm such that a third arcuate corner is formed with the gripping portion and the first arm and a fourth arcuate corner is formed with the gripping portion and the second arm, and wherein a third reinforcement rib extends at least partially around the third arcuate corner on the surface.

8. The bottle handle of claim 1, wherein each of the first reinforcement rib and the second reinforcement rib is semicircular in cross-section and each has a radius of curvature in cross-section, and wherein the offset distance is less than or equal to twice the radius of curvature.

* * * * *